US009461369B1

(12) United States Patent
Liang et al.

(10) Patent No.: US 9,461,369 B1
(45) Date of Patent: Oct. 4, 2016

(54) MULTI-BAND ANTENNA STRUCTURE

(71) Applicant: GRAND-TEK TECHNOLOGY CO., LTD., New Taipei (TW)

(72) Inventors: I-Sheng Liang, New Taipei (TW); Ta-Lun Lee, New Taipei (TW)

(73) Assignee: GRAND-TEK TECHNOLOGY CO., LTD., New Taipei (TW)

( * ) Notice: Subject to any disclaimer, the term of this patent is extended or adjusted under 35 U.S.C. 154(b) by 15 days.

(21) Appl. No.: 14/724,298

(22) Filed: May 28, 2015

(51) Int. Cl.
*H01Q 21/30* (2006.01)
*H01Q 21/24* (2006.01)
*H01Q 21/28* (2006.01)

(52) U.S. Cl.
CPC ..... *H01Q 21/245* (2013.01); *H01Q 21/24* (2013.01); *H01Q 21/28* (2013.01)

(58) Field of Classification Search
CPC ..... H01Q 21/245; H01Q 21/24; H01Q 21/28
USPC ..... 343/893, 904, 908
See application file for complete search history.

(56) References Cited

U.S. PATENT DOCUMENTS 6,339,405 B1 * 1/2002 Gleener ..... H01Q 1/243 343/700 MS
8,305,273 B2 * 11/2012 Cheng ..... H01Q 1/243 343/700 MS
8,441,408 B2 * 5/2013 Kim ..... H01Q 1/521 343/700 MS
8,525,742 B2 * 9/2013 Yang ..... H01Q 1/38 343/700 MS
2004/0233106 A1 11/2004 Rao et al.
2010/0265151 A1 10/2010 Chou
2014/0203995 A1 * 7/2014 Romney ..... H01Q 19/17 343/893

FOREIGN PATENT DOCUMENTS

TW 200603484 1/2006
WO 2012102576 A2 8/2012

OTHER PUBLICATIONS

Office Action dated Jun. 6, 2016 of the corresponding Taiwan patent application.

* cited by examiner

*Primary Examiner* — Brian Young
(74) *Attorney, Agent, or Firm* — Chun-Ming Shih; HDLS IPR Services

(57) ABSTRACT

A substrate has a front face and a back face. A first antenna and a second antenna are arranged on the front face in interlaced manner such that a first signal feeding point of the first antenna and a second signal feeding point of the second antenna are arranged on the same face or the same location. A ground face is arranged on the back face of the substrate and opposite to the first antenna and the second antenna. A cross-connect element is fixed on the ground face and electrically connected to the second antenna. The first antenna and the second antenna become a dual polarization array antenna structure for providing multi-band operation when receiving or transmitting a signal flowing through a first metal wire or a second metal wire at a length of a half of a wavelength of the signal.

15 Claims, 6 Drawing Sheets

MULTI-BAND ANTENNA STRUCTURE

BACKGROUND OF THE INVENTION

1. Field of the Invention

The present invention relates to an antenna, and especially relates to a multi-band antenna structure which is suitable for different frequency bands.

2. Description of the Related Art

In recent years, wireless communication technology is rapidly developed. Long term evolution (LTE) communication technology is provided. The frequency bands of LTE700/2300/2500 comprise 704-960 MHz and 1710-2690 MHz, covering five frequency bands of wireless wide area network (WWAN). Comparing to the conventional wireless local area network (WLAN) 2.4G and 5G antenna, the LTE antenna covers lower frequency and wider bandwidth. Therefore, it needs to pay attention to both antenna multi-band operation and receiving quality for the antenna design.

However, when the conventional multi-band antenna is manufactured, it comprises a plurality of antennas which are manufactured by using sheet metal press forming technology, and the antennas are bended and electrically connected on a single printed circuit board, so that the antennas form a dual polarization array multi-band antenna structure. Or the patterns of the antennas are printed on the copper film of the printed circuit board by using printing technology, and then the patterns of the antennas are manufactured by using exposal, development and etching technology. Plural printed circuit boards with the patterns of the antennas are stacked as a dual polarization array multi-band antenna structure. The multi-band antenna structure can be used in different frequency bands when receiving or transmitting signals.

Both of the multi-band antennas mentioned above comprise a plurality of antennas, so that the volume and size of the multi-band antennas are larger and the cost is increased. Moreover, installing the multi-band antenna is difficult because the signal feeding points of the multi-band antennas are on different faces or locations.

SUMMARY OF THE INVENTION

In order to solve the above-mentioned problems, an object of the present invention is to provide a multi-band antenna structure which is redesigned as the plane style. The signal feeding points of a first antenna (namely, a horizontally polarized antenna) and a second antenna (namely, a vertically polarized antenna) are arranged on the same face or the same location, so that the volume and size of the multi-band antenna are reduced. Manufacturing the multi-band antenna of the present invention is easier and the manufacturing cost is lower.

In order to achieve the object of the present invention mentioned above, the multi-band antenna structure includes a substrate, a first antenna, a second antenna, a ground face and a cross-connect element. The substrate has a front face and a back face. The first antenna is arranged on the front face of the substrate. The first antenna includes a first metal wire. The first metal wire includes a first signal feeding point. Two symmetric first high frequency radiation surfaces and two symmetric first low frequency radiation surfaces are electrically connected to the first metal wire. A first filter is electrically connected between the first high frequency radiation surface and the first low frequency radiation surface. The second antenna and the first antenna are arranged on the front face of the substrate in interlaced manner. The second antenna includes two second metal wires. One of the second metal wires includes a second signal feeding point and an electrical cross-connect point. The other second metal wire includes another electrical cross-connect point. Two symmetric second high frequency radiation surfaces and two symmetric second low frequency radiation surfaces are electrically connected to the second metal wire. A second filter is electrically connected between the second high frequency radiation surface and the second low frequency radiation surface. The ground face is arranged on the back face of the substrate. The ground face includes a central block opposite to the first signal feeding point, the second signal feeding point and two electrical cross-connect points. Lead wires opposite to the first metal wire and the second metal wire which are on the front face of the substrate are extended from each of sides of the central block. The lead wire is electrically connected to a first block, a second block and a third block. The cross-connect element is fixed connected to the central block and electrically connected to the second metal wire. The first antenna and the second antenna become a dual polarization array antenna structure for providing multi-band operation to increase an antenna gain when receiving a signal flowing through the first metal wire or the second metal wire at a length of a half of a wavelength of the signal.

In an embodiment of the present invention, the first metal wire further comprises a first meander line in rectangular-shaped, and one of the second metal wires comprises a second meander line in rectangular-shaped.

In an embodiment of the present invention, the first signal feeding point comprises a first piercing hole piercing the substrate, and the second signal feeding point comprises a second piercing hole piercing the substrate.

In an embodiment of the present invention, the first high frequency radiation surface is in square-shaped having a corner-truncated side electrically connected to the first metal wire, and the second high frequency radiation surface is in square-shaped having a corner-truncated side electrically connected to the second metal wire.

In an embodiment of the present invention, the first low frequency radiation surface is an L-shaped line segment electrically connected to the first metal wire, and the second low frequency radiation surface is an L-shaped line segment electrically connected to the second metal wire.

In an embodiment of the present invention, the first filter comprises a straight fine line electrically connected to the first metal wire, and an L-shaped fine line is extended from each of two sides of the straight fine line. The second filter comprises a straight fine line electrically connected to the second metal wire, and an L-shaped fine line is extended from each of two sides of the straight fine line.

In an embodiment of the present invention, line widths of the first metal wire and the second metal wire are different, so that an impedance matching of the multi-band antenna structure is adjustable.

In an embodiment of the present invention, each of the two electrical cross-connect points includes an assembly hole piercing the substrate.

In an embodiment of the present invention, the substrate further comprises a plurality of fixed holes and a through hole.

In an embodiment of the present invention, the central block of the ground face is opposite to a first meander line, a second meander line, a fixed hole and the through hole.

In an embodiment of the present invention, the first block is in square-shaped having a corner-truncated side electrically connected to the lead wires. The first block is arranged directing to the first high frequency radiation surfaces and the second high frequency radiation surfaces and is arranged on the back face of the substrate.

In an embodiment of the present invention, the second block is in square-shaped, and is arranged opposite to the first filter and the second filter on the front face of the substrate, and is electrically connected to the lead wires.

In an embodiment of the present invention, the third block is an L-shaped line segment and is arranged reversely-directing to the first low frequency radiation surfaces and the second low frequency radiation surfaces, and is arranged on the back face of the substrate, and is electrically connected to the lead wires.

In an embodiment of the present invention, the cross-connect element comprises a carrier plate. The carrier plate comprises a radio frequency path. Each of two sides of the radio frequency path comprises a thru hole. The thru hole is electrically connected to a conductive pin or is infilled with a conductive tin. The thru hole is electrically connected to the two second metal wires through the two electrical cross-connect points, and through the conductive pin or the conductive tin.

In an embodiment of the present invention, the substrate and the carrier plate are glass fiber boards.

DETAILED DESCRIPTION OF THE INVENTION

Please refer to following detailed description and figures for the technical content of the present invention.

Figure 1A:
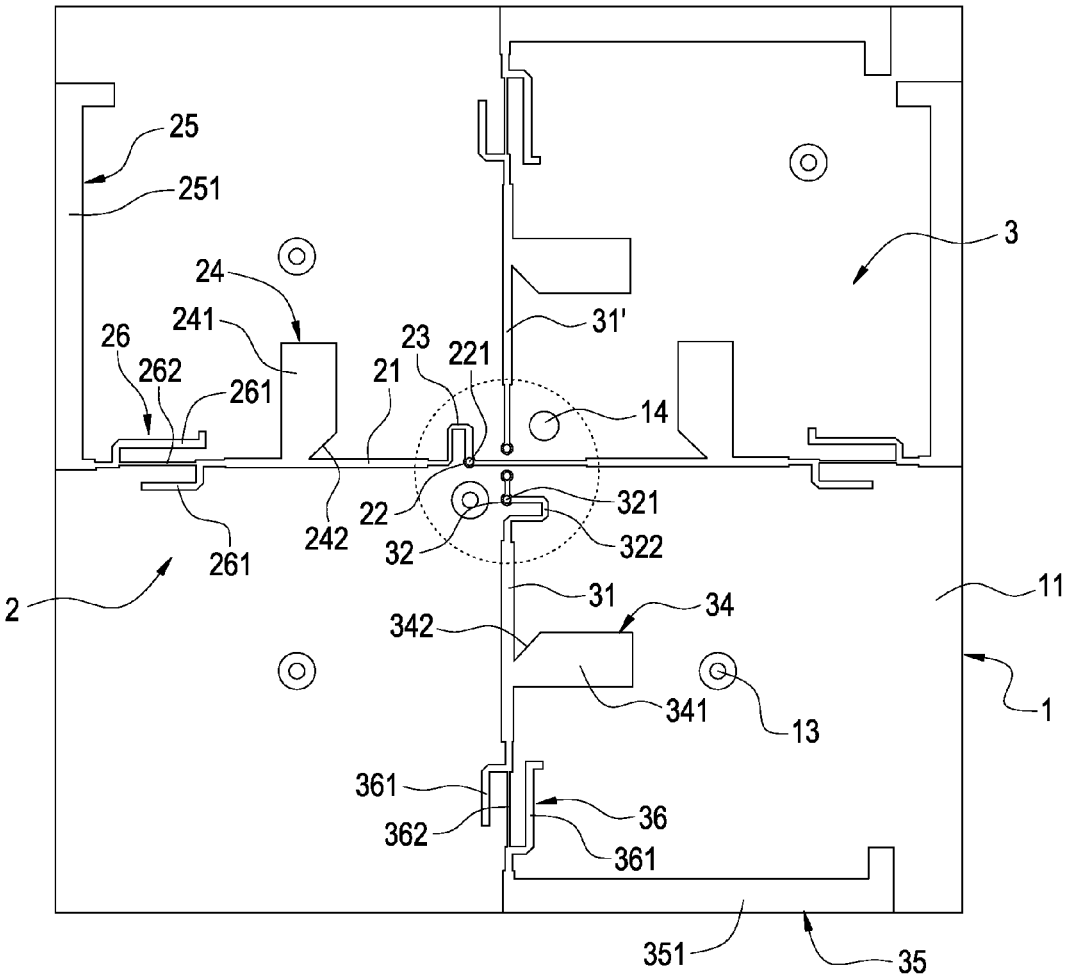
FIG. 1*a* shows a front side drawing of the multi-band antenna structure of the present invention.
Figure 1B:
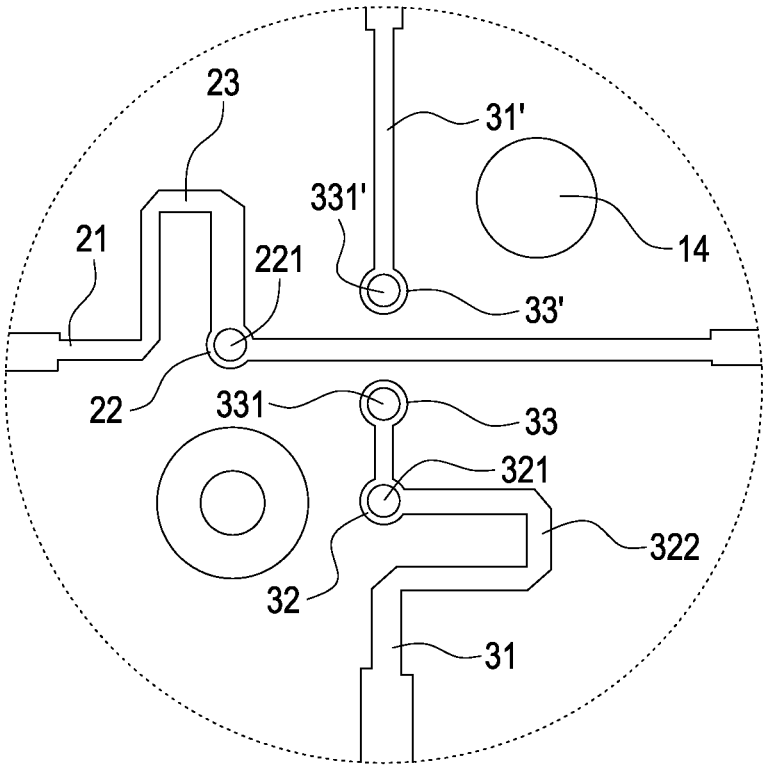
FIG. 1*b* shows a partial enlarged drawing of FIG. 1*a*.
Figure 2:
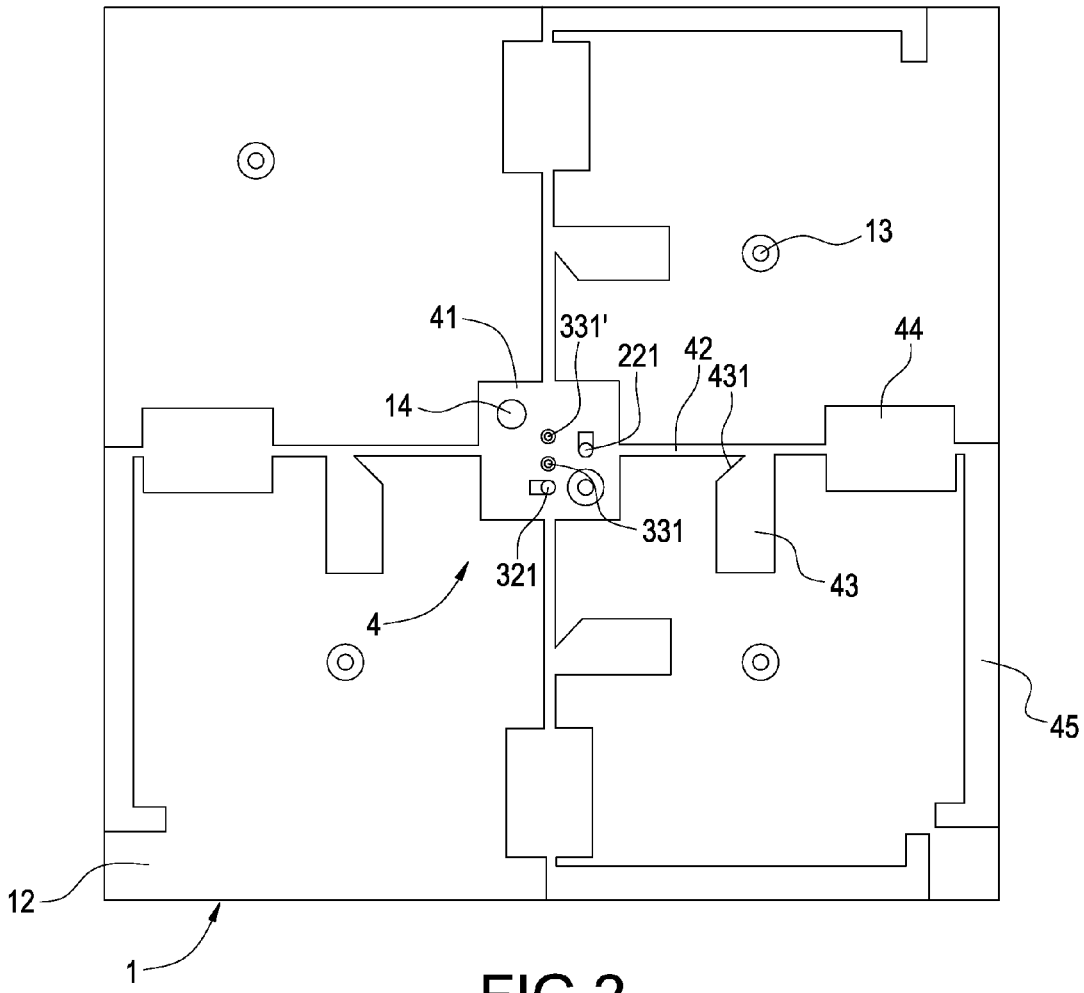
FIG. 2 shows a back side drawing of the multi-band antenna structure of the present invention.
Figure 3:
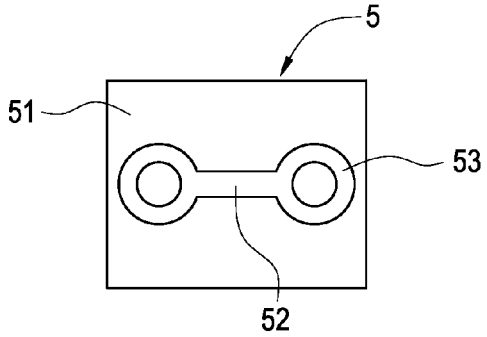
FIG. 3 shows the carrier plate of the present invention.

FIG. 1*a* shows a front side drawing of the multi-band antenna structure of the present invention. FIG. 1*b* shows a partial enlarged drawing of FIG. 1*a*. FIG. 2 shows a back side drawing of the multi-band antenna structure of the present invention. FIG. 3 shows the carrier plate of the present invention. As shown in FIG. 1*a*, FIG. 1*b*, FIG. 2 and FIG. 3, the multi-band antenna structure of the present invention includes a substrate 1, a first antenna 2, a second antenna 3, a ground face 4 and a cross-connect element 5.

The substrate 1 has a front face 11, a back face 12, a plurality of fixed holes 13 (piercing the substrate 1) and a through hole 14. In FIG. 1*a*, FIG. 1*b*, FIG. 2 and FIG. 3, the substrate 1 is a glass fiber board.

The first antenna 2 is arranged on the front face 11 of the substrate 1. The first antenna 2 includes a first metal wire 21. The first metal wire 21 includes a first signal feeding point 22 and a first meander line 23 in rectangular-shaped. The first signal feeding point 22 comprises a first piercing hole 221 piercing the substrate 1. A signal feed-in cable (not shown in FIG. 1*a*, FIG. 1*b*, FIG. 2 and FIG. 3) is arranged piercing the first piercing hole 221 to be electrically connected to the first signal feeding point 22. Two symmetric first high frequency radiation surfaces 24 and two symmetric first low frequency radiation surfaces 25 are electrically connected to the first metal wire 21. A first filter 26 is electrically connected between the first high frequency radiation surface 24 and the first low frequency radiation surface 25. The first filter 26 is an isolated component arranged between the first high frequency radiation surface 24 and the first low frequency radiation surface 25, so that high-frequency signals will not impact low-frequency signals directly. The first high frequency radiation surface 24 mentioned above includes a square block 241. The square block 241 includes a corner-truncated side 242 electrically connected to the first metal wire 21. The first low frequency radiation surface 25 mentioned above is an L-shaped line segment 251 electrically connected to the first metal wire 21. The first filter 26 mentioned above comprises a straight fine line 261 electrically connected to the first metal wire 21, and an L-shaped fine line 262 is extended from each of two sides of the straight fine line 261. In FIG. 1*a*, FIG. 1*b*, FIG. 2 and FIG. 3, the first antenna 2 is defined as a horizontally polarized antenna or a vertically polarized antenna according to the placed location or the direction. Line widths of the first metal wire 21 are different, so that an impedance matching of the multi-band antenna structure is adjustable.

The second antenna 3 and the first antenna 2 are arranged on the front face 11 of the substrate 1 in interlaced manner. The second antenna 3 includes a second metal wire 31 and a second metal wire 31'. The second metal wire 31 includes a second signal feeding point 32 and a second meander line 322 in rectangular-shaped. The second signal feeding point 32 comprises a second piercing hole 321 piercing the substrate 1. A signal feed-in cable (not shown in FIG. 1*a*, FIG. 1*b*, FIG. 2 and FIG. 3) is arranged piercing the second piercing hole 321 to be electrically connected to the second signal feeding point 32. The second metal wire 31 includes an electrical cross-connect point 33. The second metal wire 31' includes an electrical cross-connect point 33'. The electrical cross-connect point 33 and the electrical cross-connect point 33' respectively includes an assembly hole 331 and an assembly hole 331' piercing the substrate 1. The assembly hole 331 and the assembly hole 331' are electrically connected to the cross-connect element 5, so that the second metal wire 31 and the second metal wire 31' which are separated by the first antenna 2 can be electrically connected to each other to form a single second metal wire. Two symmetric second high frequency radiation surfaces 34 and two symmetric second low frequency radiation surfaces 35 are electrically connected to the second metal wire 31 and the second metal wire 31'. A second filter 36 is electrically connected between the second high frequency radiation surface 34 and the second low frequency radiation surface 35. The second filter 36 is an isolated component arranged between the second high frequency radiation surface 34 and the second low frequency radiation surface 35, so that high-frequency signals will not impact low-frequency signals. The second high frequency radiation surface 34 mentioned above includes a square block 341. The square block 341 includes a corner-truncated side 342 electrically connected to the second metal wire 31 and the second metal wire 31'. The second low frequency radiation surface 35 mentioned above is an L-shaped line segment 351 electrically connected to the second metal wire 31 and the second metal wire 31'. The second filter 36 mentioned above comprises a straight fine line 361 electrically connected to the second metal wire 31 and the second metal wire 31', and an L-shaped fine line 362 is extended from each of two sides of the straight fine line 361. In FIG. 1*a*, FIG. 1*b*, FIG. 2 and FIG. 3, the second antenna 3 is defined as a horizontally polarized antenna or a vertically polarized antenna according to the placed location or the direction. Line widths of the second metal wire 31 and the second metal wire 31' are different, so that the impedance matching of the multi-band antenna structure is adjustable.

The ground face 4 is arranged on the back face 12 of the substrate 1. The ground face 4 includes a central block 41 opposite to the first signal feeding point 22, the first meander line 23, the second signal feeding point 32, the second meander line 322, the assembly hole 331, the assembly hole 331', the fixed hole 13 and the through hole 14. Lead wires 42 opposite to the first metal wire 21 and the second metal wire 31 which are on the front face 11 of the substrate 1 are extended from each of sides of the central block 41. The lead wire 42 is electrically connected to a first block 43, a second block 44 and a third block 45. The first block 43 is in square-shaped having a corner-truncated side 431 electrically connected to the lead wires 42. The first block 43 is arranged directing to the first high frequency radiation surfaces 24 and the second high frequency radiation surfaces 34 and is arranged on the back face 12 of the substrate 1. The second block 44 is in square-shaped, and is arranged opposite to the first filter 26 and the second filter 36 on the front face 11 of the substrate 1, and is electrically connected to the lead wires 42. The third block 45 is an L-shaped line segment and is arranged reversely-directing to the first low frequency radiation surfaces 25 and the second low frequency radiation surfaces 35, and is arranged on the back face 12 of the substrate 1, and is electrically connected to the lead wires 42.

The cross-connect element 5 comprises a carrier plate 51. The carrier plate 51 comprises a radio frequency path 52. Each of two sides of the radio frequency path 52 comprises a thru hole 53. The thru hole 53 is electrically connected to a conductive pin or is infilled with a conductive tin. The carrier plate 51 is fixed connected on the central block 41. The two conductive pins or the conductive tins are through the assembly hole 331 and the assembly hole 331' and are not electrically connected to the central block 41, and is only electrically connected to the second metal wire 31. In FIG. 1*a*, FIG. 1*b*, FIG. 2 and FIG. 3, the carrier plate 51 is a glass fiber board.

According to the multi-band antenna structure mentioned above, the signal feeding points of the horizontally polarized antenna and the vertically polarized antenna are arranged on the same face or the same location, so that the volume and size of the multi-band antenna are reduced. Manufacturing the multi-band antenna of the present invention is easier and the manufacturing cost is lower.

Figure 4:
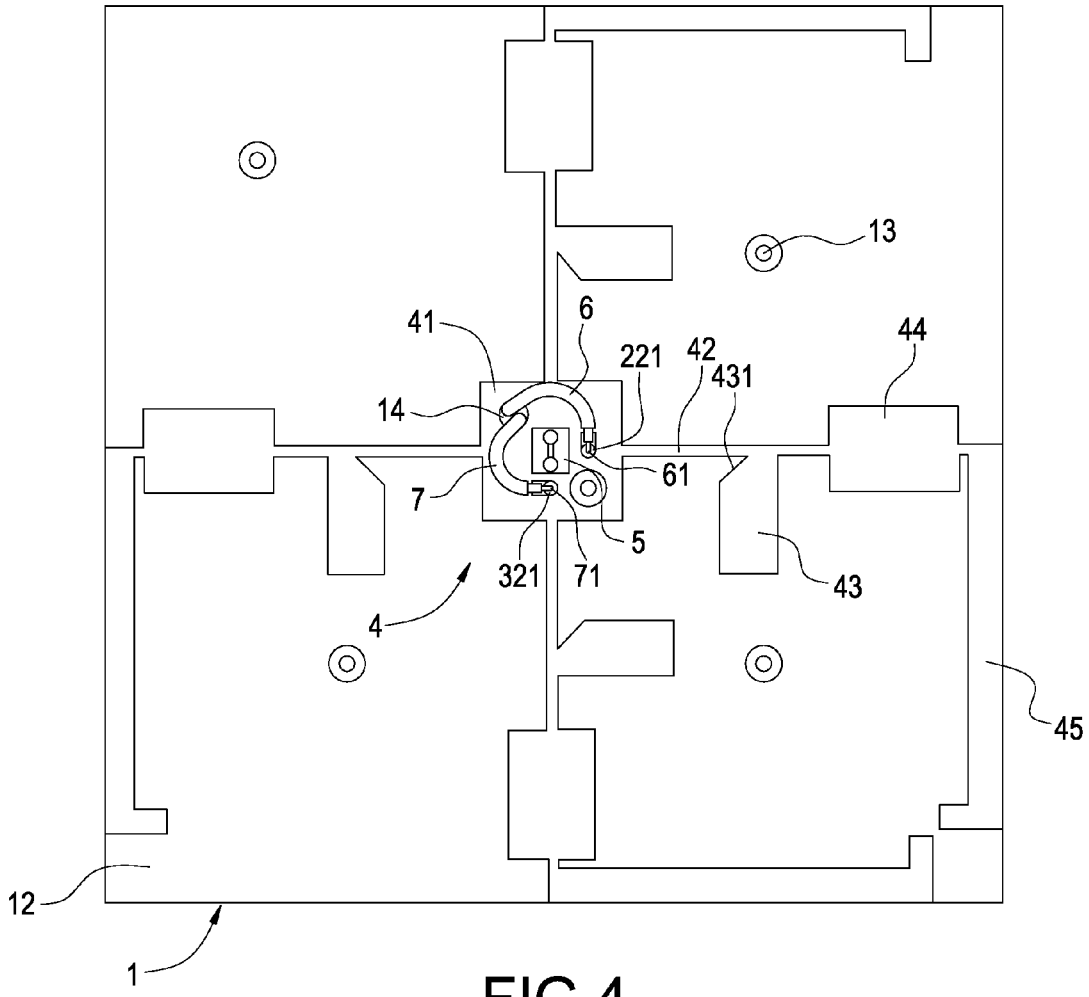
FIG. 4 shows a back side drawing of the multi-band antenna structure of the present invention electrically connected to signal cables.

FIG. 4 shows a back side drawing of the multi-band antenna structure of the present invention electrically connected to signal cables. As shown in FIG. 4, the multi-band antenna of the present invention is electrically connected to signal cables. A ground line (not shown in FIG. 4) of a first cable 6 is electrically connected to the central block 41 after the first cable 6 and a second cable 7 are arranged through the through hole 14. A conducting wire 61 of the first cable 6 is through the first piercing hole 221 and is electrically connected to the first signal feeding point 22. A ground line (not shown in FIG. 4) of the second cable 7 is electrically connected to the central block 41. A conducting wire 71 of the second cable 7 is through the second piercing hole 321 and is electrically connected to the second signal feeding point 32.

The first antenna 1 and the second antenna 2 become a dual polarization array antenna structure for receiving signals in different frequency bands to increase an antenna gain when receiving or transmitting signals flowing through the first metal wire 21 or the second metal wire 31 (or the second metal wire 31') at a length of a half of a wavelength of the signals.

The first antenna 2 or the second antenna 3 is defined as a horizontally polarized antenna or a vertically polarized antenna according to the placed location or the direction after the multi-band antenna is installed.

Figure 5:
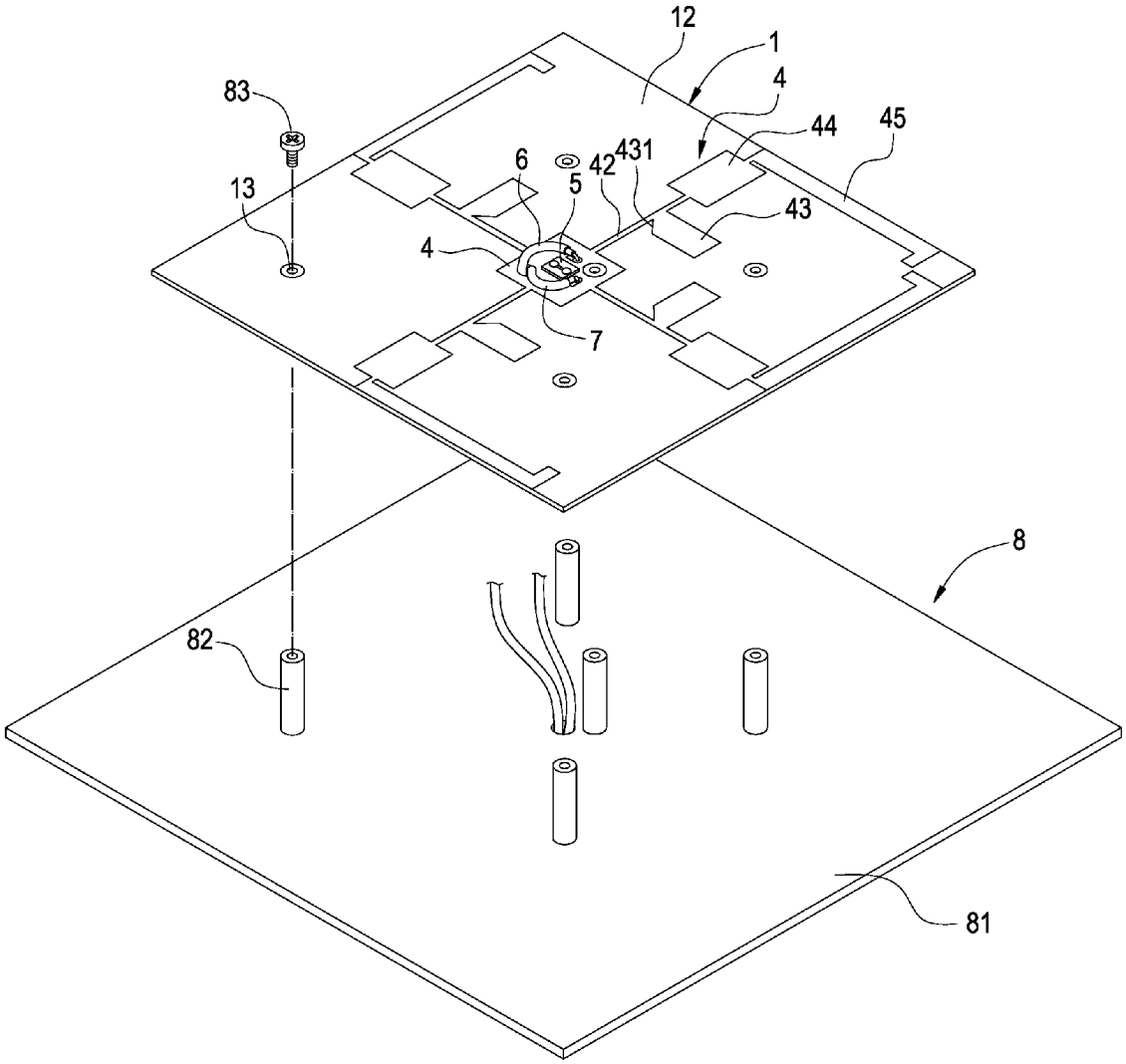
FIG. 5 shows an exploded view of the multi-band antenna structure and the casing of the present invention.
Figure 6:
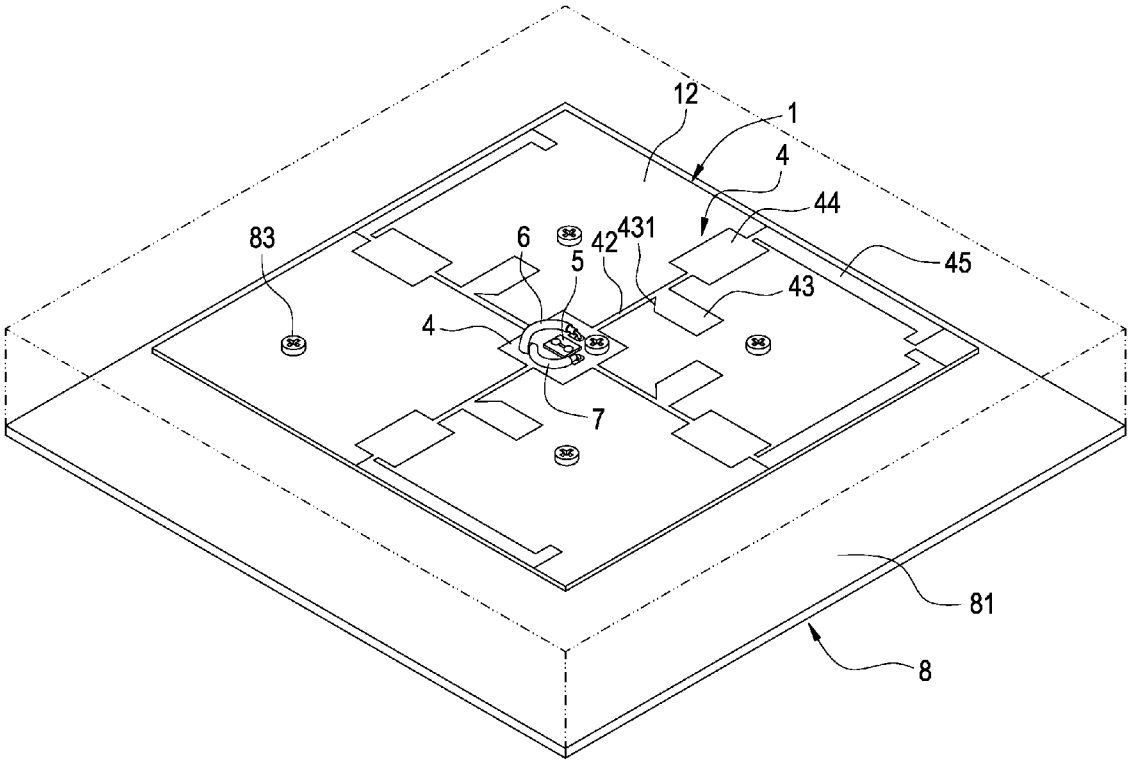
FIG. 6 shows an assembly drawing of the multi-band antenna structure and the casing of the present invention.

FIG. 5 shows an exploded view of the multi-band antenna structure and the casing of the present invention. FIG. 6 shows an assembly drawing of the multi-band antenna structure and the casing of the present invention. As shown in FIG. 5 and FIG. 6, the multi-band antenna structure is assembled with a casing 8 after the first cable 6 of the multi-band antenna structure is electrically connected to the second cable 7 of the multi-band antenna structure. The fixed holes 13 of the substrate 1 are opposite to the fixing columns 82 on a base 81 of the casing 8. Fixing elements 83 are through the fixed holes 13 to fix to the fixing columns 82, so that the multi-band antenna structure is fixed on the base 81. After the multi-band antenna structure is installed on the base 81, a cover 84 is assembled on the base 81 to cover the multi-band antenna structure to form a dual polarization antenna for receiving multi-band frequencies.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A multi-band antenna structure comprising:

a substrate having a front face and a back face;

a first antenna arranged on the front face of the substrate, the first antenna including a first metal wire, the first metal wire including a first signal feeding point, two symmetric first high frequency radiation surfaces and two symmetric first low frequency radiation surface electrically connected to the first metal wire, a first filter electrically connected between the first high frequency radiation surface and the first low frequency radiation surface;

a second antenna, the second antenna and the first antenna arranged on the front face of the substrate in interlaced manner, the second antenna including two second metal wires, one of the second metal wires including a second signal feeding point and an electrical cross-connect point, the other second metal wire including another electrical cross-connect point, two symmetric second high frequency radiation surfaces and two symmetric second low frequency radiation surfaces electrically connected to the second metal wire, a second filter electrically connected between the second high frequency radiation surface and the second low frequency radiation surface;

a ground face arranged on the back face of the substrate, the ground face including a central block opposite to the first signal feeding point, the second signal feeding point and two electrical cross-connect points, lead wires opposite to the first metal wire and the second metal wire on the front face of the substrate extended from each of sides of the central block, the lead wire electrically connected to a first block, a second block and a third block; and a cross-connect element fixed connected to the central block and electrically connected to the second metal wire, wherein the first antenna and the second antenna become a dual polarization array antenna structure for providing multi-band operation to increase an antenna gain when receiving a signal flowing through the first metal wire or the second metal wire at a length of a half of a wavelength of the signal.

2. The multi-band antenna structure in claim 1, wherein the first metal wire further comprises a first meander line in rectangular-shaped, and one of the second metal wires comprises a second meander line in rectangular-shaped.

3. The multi-band antenna structure in claim 2, wherein the first signal feeding point comprises a first piercing hole piercing the substrate, and the second signal feeding point comprises a second piercing hole piercing the substrate.

4. The multi-band antenna structure in claim 1, wherein the first high frequency radiation surface is in square-shaped having a corner-truncated side electrically connected to the first metal wire, and the second high frequency radiation surface is in square-shaped having a corner-truncated side electrically connected to the second metal wires.

5. The multi-band antenna structure in claim 4, wherein the first low frequency radiation surface is an L-shaped line segment electrically connected to the first metal wire, and the second low frequency radiation surface is an L-shaped line segment electrically connected to the second metal wire.

6. The multi-band antenna structure in claim 5, wherein the first filter comprises a straight fine line electrically connected to the first metal wire, and an L-shaped fine line is extended from each of two sides of the straight fine line; the second filter comprises a straight fine line electrically connected to the second metal wire, and an L-shaped fine line is extended from each of two sides of the straight fine line.

7. The multi-band antenna structure in claim 1, wherein line widths of the first metal wire and the second metal wire are different, so that an impedance matching of the multi-band antenna structure is adjustable.

8. The multi-band antenna structure in claim 1, wherein each of the two electrical cross-connect points includes an assembly hole piercing the substrate.

9. The multi-band antenna structure in claim 1, wherein the substrate further comprises a plurality of fixed holes and a through hole.

10. The multi-band antenna structure in claim 1, wherein the central block of the ground face is opposite to a first meander line, a second meander line, a fixed hole and a through hole.

11. The multi-band antenna structure in claim 1, wherein the first block is in square-shaped having a corner-truncated side electrically connected to the lead wires; the first block is arranged directing to the first high frequency radiation surfaces and the second high frequency radiation surfaces and is arranged on the back face of the substrate.

12. The multi-band antenna structure in claim 11, wherein the second block is in square-shaped, and is arranged opposite to the first filter and the second filter on the front face of the substrate, and is electrically connected to the lead wires.

13. The multi-band antenna structure in claim 12, wherein the third block is an L-shaped line segment and is arranged reversely-directing to the first low frequency radiation surfaces and the second low frequency radiation surfaces, and is arranged on the back face of the substrate, and is electrically connected to the lead wires.

14. The multi-band antenna structure in claim 13, wherein the cross-connect element comprises a carrier plate; the carrier plate comprises a radio frequency path; each of two sides of the radio frequency path comprises a thru hole; the thru hole is electrically connected to a conductive pin or is infilled with a conductive tin; the thru hole is electrically connected to the two second metal wires through the two electrical cross-connect points, and through the conductive pin or the conductive tin.

15. The multi-band antenna structure in claim 14, wherein the substrate and the carrier plate are glass fiber boards.

* * * * *